US006712218B2

(12) United States Patent
Nierop

(10) Patent No.: US 6,712,218 B2
(45) Date of Patent: Mar. 30, 2004

(54) SOIL SCREENER

(76) Inventor: Klaas Nierop, Suite 184, 101 - 1865 Dilworth Drive, Kelowna, British Columbia (CA), V1Y 9T1

( * ) Notice: Subject to any disclaimer, the term of this patent is extended or adjusted under 35 U.S.C. 154(b) by 0 days.

(21) Appl. No.: 10/207,809

(22) Filed: Jul. 31, 2002

(65) Prior Publication Data

US 2004/0020830 A1 Feb. 5, 2004

(51) Int. Cl.[7] ..... B07C 1/28
(52) U.S. Cl. ..... 209/420; 209/421; 209/413
(58) Field of Search ..... 209/409, 412, 209/413, 420, 421

(56) References Cited

U.S. PATENT DOCUMENTS

| | | | | |
|---|---|---|---|---|
| 1,424,451 A | | 8/1922 | Crandall | |
| 1,510,742 A | | 10/1924 | Gutleben | |
| 1,820,944 A | * | 9/1931 | Marx | 209/420 |
| 2,037,078 A | | 4/1936 | Levy | |
| 3,307,698 A | | 3/1967 | Haffner | |
| 3,439,806 A | * | 4/1969 | Kass et al. | 209/420 X |
| 3,732,980 A | | 5/1973 | Evers et al. | |
| 4,350,584 A | | 9/1982 | Donington | |
| 4,381,235 A | | 4/1983 | Mallaghan | |
| 4,505,812 A | | 3/1985 | Lees | |
| 5,112,474 A | * | 5/1992 | Douglas | 209/240 |
| 5,335,784 A | | 8/1994 | Tyler | |
| 5,392,925 A | | 2/1995 | Seyffert | |
| 5,641,071 A | | 6/1997 | Read et al. | |
| 6,059,119 A | | 5/2000 | Davis | |
| 6,439,393 B1 | * | 8/2002 | Zeller | 209/405 |

FOREIGN PATENT DOCUMENTS

| | | |
|---|---|---|
| CA | 824997 | 10/1969 |
| CA | 1144111 | 4/1983 |
| CA | 1208604 | 7/1986 |
| CA | 1277633 | 12/1990 |
| CA | 2200147 | 9/1997 |
| EP | 0 692 580 | 8/2000 |
| WO | PCT/US97/01722 | 7/1998 |

* cited by examiner

*Primary Examiner*—Donald P. Walsh
*Assistant Examiner*—Jonathan R. Miller
(74) *Attorney, Agent, or Firm*—Antony C. Edwards

(57) ABSTRACT

A soil screening device includes a screen frame having a screening surface, and a supporting frame. The supporting frame may have rearwardly disposed rigid uprights supporting the screen frame. The screen frame is pivotally mounted to a first upper member mounted at an upper end of the uprights, for pivoting between a lowered position and an elevated position. The supporting frame has a base frame extending forwardly of the uprights. Upper members of the base frame have at least one wedge selectively positionably mounted thereon, for example atop the upper member of the base frame. The wedge or wedges are positionable to engage a lower edge of the screen frame when in the lowered position bearing down on an upper inclined surface of the wedge or wedges. The wedge or wedges are selectively positionable relative to the upper members of the base frame so as to selectively adjust an angular orientation of the screen frame relative to the uprights.

22 Claims, 4 Drawing Sheets

SOIL SCREENER

FIELD OF THE INVENTION

This invention relates to the field of devices for separating rocks, rubble, gravel and debris from soil and in particular to a selectively pivotable rigid mesh screen pivotally mounted on a supporting frame and adapted for use with skid-steer style front end loaders.

BACKGROUND OF THE INVENTION

It is well known that screened top soil has a certain resale value for use in landscaping and construction. During such construction it is often the case that during excavation or during land clearing or the like that quantities of top soil have to be moved and distributed in the construction site or otherwise removed from the construction site, there being a later need for screened top soil once construction is complete. It is now common that on such construction sites that relatively small skid-steer front end loaders such as sold under the trademark Bobcat are employed for minor excavation, distribution of top soil, and loading of top soil into containers for removal. Consequently, there exists a need for a robust portable soil screen device which is compatible with the use of skid-steer style front end loaders to efficiently and economically screen rocks, rubble, debris, and large particle size gravel from otherwise readily reusable top soil found for example existing on a construction site.

In the prior art, applicant is aware of U.S. Pat. No. 4,505,812 which issued to Lees for a Sieve Screen Deck on Mar. 19, 1985. What Lees discloses is a sieve screen deck having a plurality of wedge wires connected to an array of backing bars running longitudinally of the screen parallel to its fall line. The screen is connected to a frame so as to include a resilient means accommodating vibrating and flexing of the screen during rapping or vibration of the screen so as to screen solid particulate matter using slots having a width of from ten microns to four millimeters. The screen is not rotatably mounted to the supporting frame. Other patents also rely on vibrating a screen for example such as disclosed in U.S. Pat. No. 5,392,925 which issued to Seyffert on Feb. 28, 1995 for a Shale Shaker and Screen, and in U.S. Pat. No. 5,641,071 which issued Read et al. on Jun. 24, 1997 for a Convertible Material Separating Apparatus and Convertible Kits. Applicant is also aware of U.S. Pat. No. 6,059,119 which issued to Davis on May 9, 2000 for a Rock Screed Bucket. Vibratory mechanisms such as taught in these patents add complexity, weight and cost to the manufacturer of such screening devices.

Applicant is also aware of devices for screening which employ the use of inclined screens, for example, Canadian Patent No. 1,144,111 which issued Apr. 5, 1983 to Simbas for a Grading Plant, published International Patent Application No. PCT/US97/01722 filed Jan. 29, 1997 by Curtis for a Curved Freestanding Garden Sieve, U.S. Pat. No. 1,424,451 which issued to Crandall on Aug. 1, 1922 for a Combined Sand and Gravel Screen, and U.S. Pat. No. 1,510,742 which issued Oct. 7, 1924 to Gutleben for a Sand and Gravel Screen. Neither Simbas, Curtis, Crandall nor Gutleben disclose an inclined screen pivotally mounted along its upper edge to a support frame and adapted for complimentary ease of use with a skid-steer style front end loader bucket.

SUMMARY OF THE INVENTION

In summary the soil screening device of the present invention includes a screen frame having a screening surface, and a supporting frame. The supporting frame may have rearwardly disposed rigid uprights supporting the screen frame. The screen frame is pivotally mounted to a first upper member mounted at an upper end of the uprights, for pivoting between a lowered position and an elevated position. The supporting frame has a base frame extending forwardly of the uprights. Upper members of the base frame have at least one wedge selectively positionably mounted thereon, for example atop the upper member of the base frame. The wedge or wedges are positionable to engage a lower edge of the screen frame when in the lowered position bearing down on an upper inclined surface of the wedge or wedges. The wedge or wedges are selectively positionable relative to the upper members of the base frame so as to selectively adjust an angular orientation of the screen frame relative to the uprights.

The uprights define a first rear opening between the uprights and under the screen frame. The opening is sized to accept a front end loader bucket therethrough for engagement of the bucket with an underside of the screen frame. File base frame defines a second rear opening below the first rear opening. The second rear opening is sized to accept the bucket therethrough for engagement of the bucket with cross members of the base frame. The base frame may be substantially a parallelepiped and the first and second rear openings may be substantially rectangular. The uprights may be a parallel and spaced apart pair of uprights bounding opposite ends of the first and second rear openings.

The cross members may include at least a rear-most cross member adjacent the uprights. At least one rigid member may depend downwardly from the rear-most cross member for releasably locking behind a rear edge of the bucket when the bucket is fully inserted into and through the second rear opening.

The upper members may include at least one channel member forming an upwardly opening channel in which a wedge is slidably mounted. The at least one channel member may be perpendicular to the uprights, and may be orthogonal to the first rear opening. The at least one channel member may include locking means for releasably lockably positioning wedges along the at least one channel member. The at least one channel member may be a parallel pair of spaced apart channel members mounted adjacent opposite ends of the base frame, and consequently at least one wedge may be a pair of wedges mounted in the channel members.

The first upper member may be a horizontal cross bar between the uprights. An upper edge of the screen frame may be parallel to the horizontal cross bar and pivotally mounted thereto by hinge means. A deflecting bar may be mounted along the upper edge of the screen frame so as to at least partially cover the hinge means.

The base frame may be sheeted across the front thereof. An upper forward edge of the base frame may be bevelled and sheeted so as to extend beneath the lower edge of the screen frame when in the lowered position to deflect debris falling from the screening surface forwardly from the base frame.

DETAILED DESCRIPTION OF EMBODIMENTS OF THE INVENTION

Figure 1:
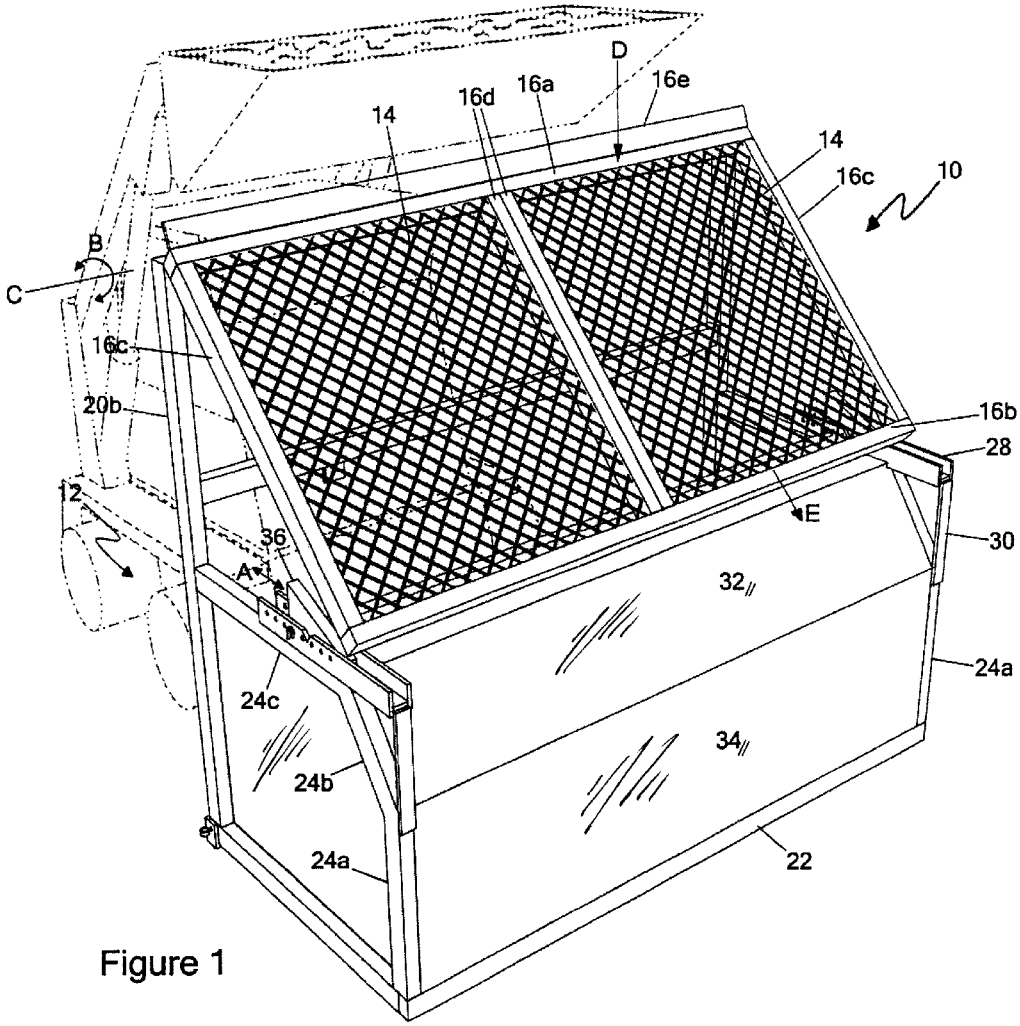
FIG. 1 is, in front perspective view, the soil screener according to the present invention.
Figure 2:
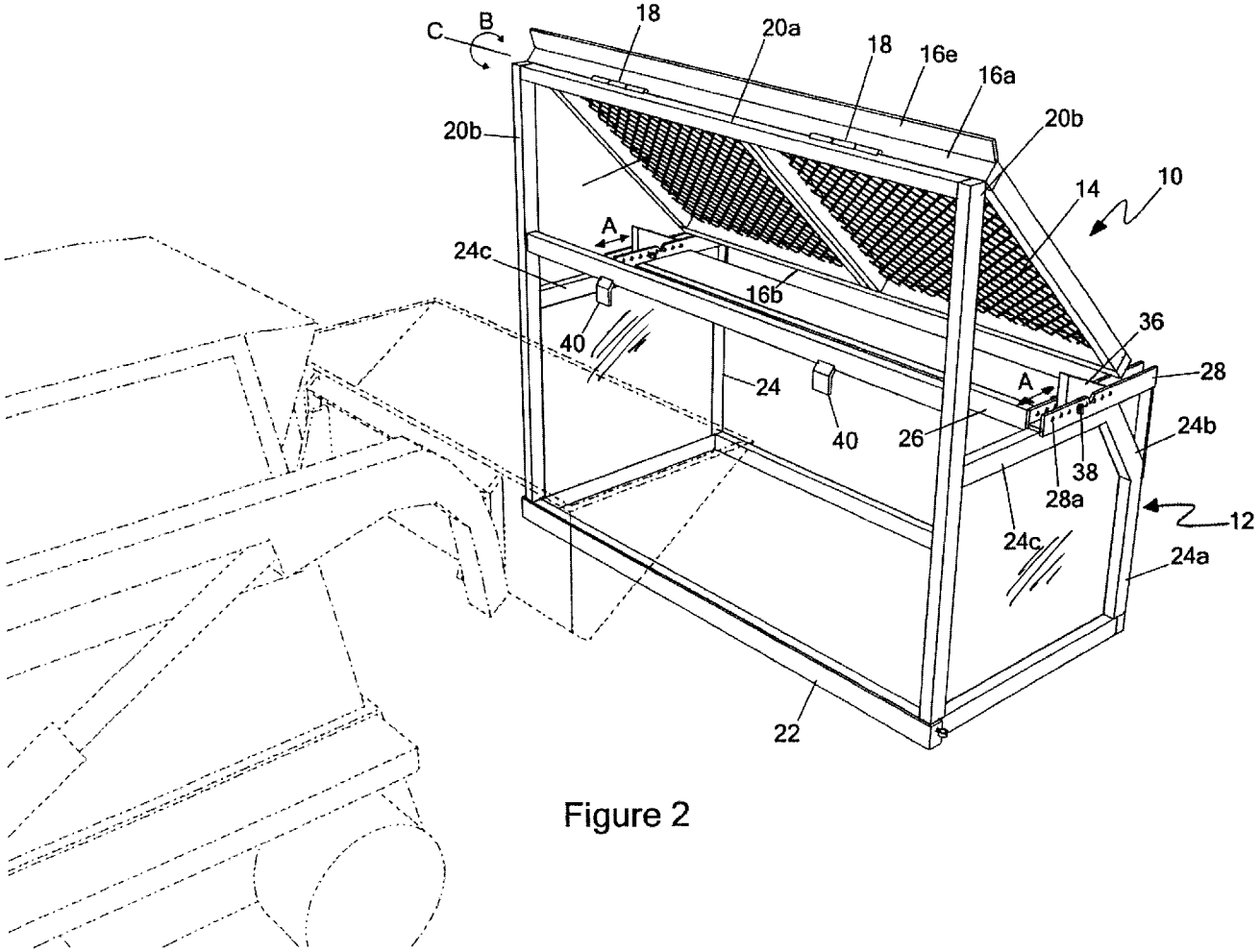
FIG. 2 is, in rear perspective view, the soil screener of FIG. 1 with a skid-steer style front end loader illustrated in dotted outline approaching the rear of the soil screener.

As seen in FIGS. 1–4, the soil screener according to one embodiment of the present invention includes a rigid planar screen 10 mounted atop a rigid supporting frame 12. Although not intending to be limiting, screen 10 may include two square frames, adjacently abutted so as to form a rectangle, each of the frames containing a square of expanded steel mesh 14 or the like rigidly mounted therein. The upper screen frame member 16*a* is pivotally mounted, by means of hinges 18 to an upper cross bar 20*a*. Upper screen frame member 16*a* and lower screen frame member 16*b* are rigidly maintained in their parallel spaced apart relation by screen frame side members 16*c* and by screen frame intermediate members 16*d*. Upper cross bar 20*a* is supported on rigid parallel uprights 20*b* mounted onto a rigid rectangular base 22. An intermediate cross bar 20*c* extends between uprights 20*b* parallel to upper cross bar 20*a* and base 22. Uprights 20*b* are mounted to base 22 at the rear corners of base 22. A parallel pair of shorter front uprights 24*a* are mounted so as to extend vertically from the front corners of base 22, parallel to rear uprights 20*b*. Front uprights 24*a* extend upwardly as unitary members through a forty-five degree corner section 24*b* and extend contiguously into a horizontal supporting arm 24*c* rigidly mounted to rear uprights 20*b*. Cross bar 26 is rigidly mounted to so as to extend between supporting cross arms 24*c*.

A pair of channel members 28 are rigidly mounted atop supporting cross arms 24*c* so as to lie along the top surface of supporting cross arms 24*c* and so as to extend outwardly over corner sections 24*b*. Channel members 28 are oriented so as to provide an upwardly open U-shaped channel in each of the parallel pair of planes containing supporting cross arms 24*c*, corner sections 24*b* and front uprights 24*a*. Rigid braces 30 are mounted to the free ends of channel members 28 and to front uprights 24*a* so as to support the free ends of channel members 28. Rigid planar sheeting 32 may be mounted in the rectangular opening defined by the parallel pair of corner sections 24*b*. The rectangular opening defined between the parallel pair of front uprights 24*a* may also be rigidly sheeted by sheeting 34.

Wedges 36 are slidably mounted in channel members 28. A pin 38 is insertable through pairs of apertures 28*a* in channel members 28 and through a corresponding bore (not shown) formed laterally through the base of wedges 36 so as to releasably lock the position of wedges 36 along the lengths of channel members 28. Thus wedges 36 may be positioned in directions A so as to adjustably engage the underside of lower screen frame member 16*b*. Wedges 36 thus allow the resting position of screen 10, with lower screen frame member 16*b* resting on the upper surfaces of wedges 36, to be rotatably adjusted in direction B about axis of rotation C.

Figure 3:
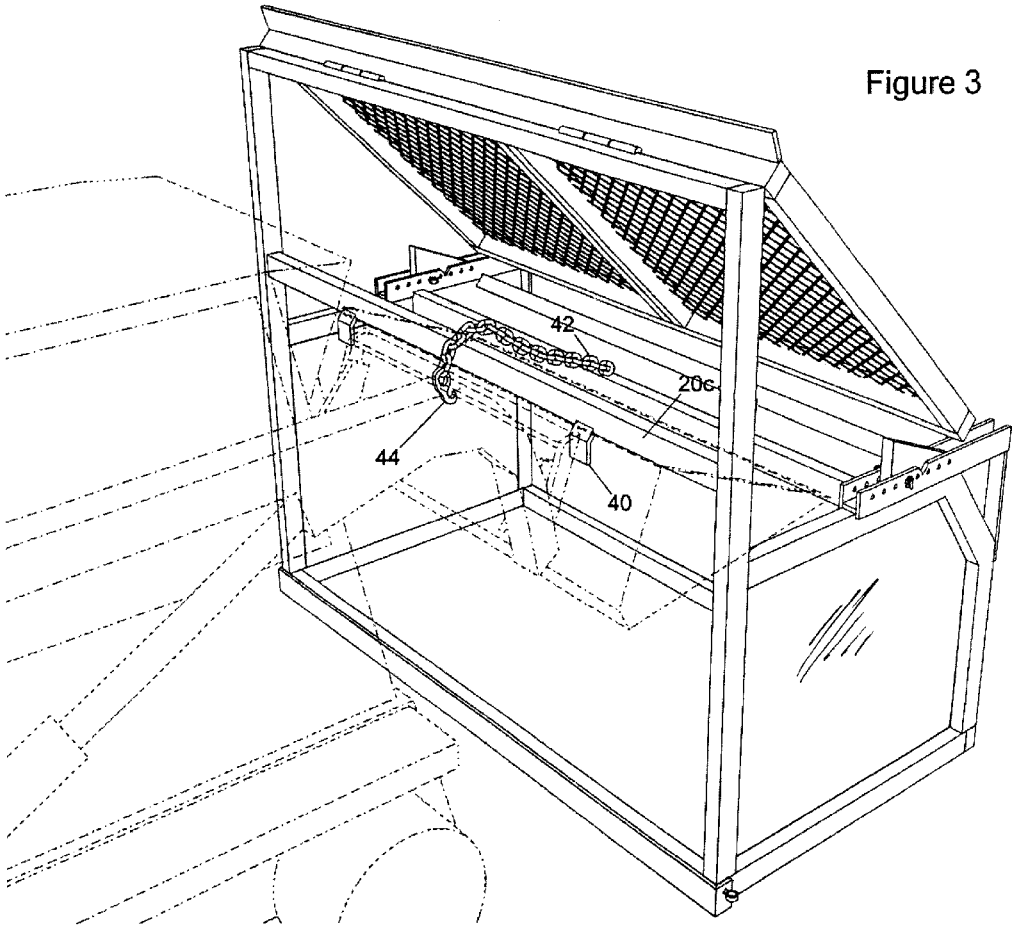
FIG. 3 illustrates the soil screener of FIG. 2 mounted onto the bucket of the skid-steer style front end loader for transportation of the soil screener.
Figure 3A:
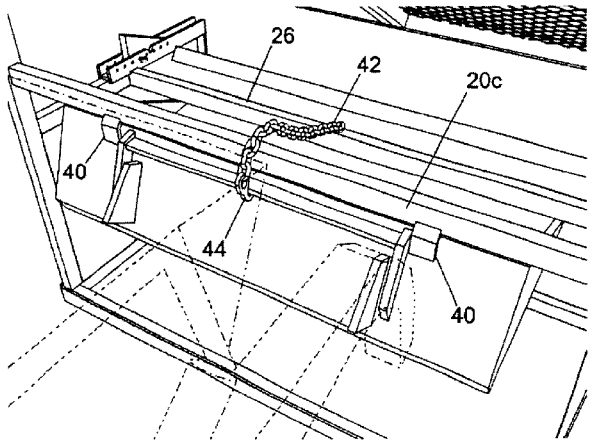
FIG. 3*a* is a partially cut away enlarged view of the mounting mechanism for mounting the soil screener of FIG. 3 onto the front end loader bucket.

In use, a skid-steer style front end loader such as the Bobcat™ illustrated, may easily lift screen 10 and supporting frame 12 by inserting the bucket through a lower rear opening in the frame and hooking the rear edge of the bucket opening, when the bucket opening is horizontal, behind down-turned rigid flanges 40 on cross bar 20*c* as seen in FIGS. 3 and 3*a*. With flanges 40 hooked behind the rear upper edge of the bucket opening, a safety chain, which is rigidly mounted as by welding to cross bar 26 on supporting frame 12, is wrapped over cross bar 20*c* so as to allow the hooking of a hook 44 mounted on the distal end of chain 42 onto a cross bar on the back of the bucket. With the bucket then bearing upwardly against cross bars 20*c* and 26, raising the bucket simultaneously raises the supporting frame 12 so that it may be transported readily to a convenient work area on the site, for example, adjacent a supply of soil to be screened.

Once the supporting frame and screen has been positioned in a desired location, the bucket is lowered to place the supporting frame on the ground and so as to release the bucket from underneath flanges 40. The bucket may then be retracted through the lower rear opening and screening operations may commence. The bucket may be immediately filled with unscreened soil and tipped from the bucket, once raised, in direction D down over deflecting flange 16*e* so as to cascade down onto and over mesh 14. Soil and other fine particulates are then free to fall through the apertures of the mesh leaving the larger particles which will not pass through the apertures of the mesh to roll or slide downwardly off the screen in direction E. Rubble flowing or rolling off mesh 14 in direction E is deflected by sheeting 32 onto a waste pile accumulating in front of sheeting 34.

Figure 4:
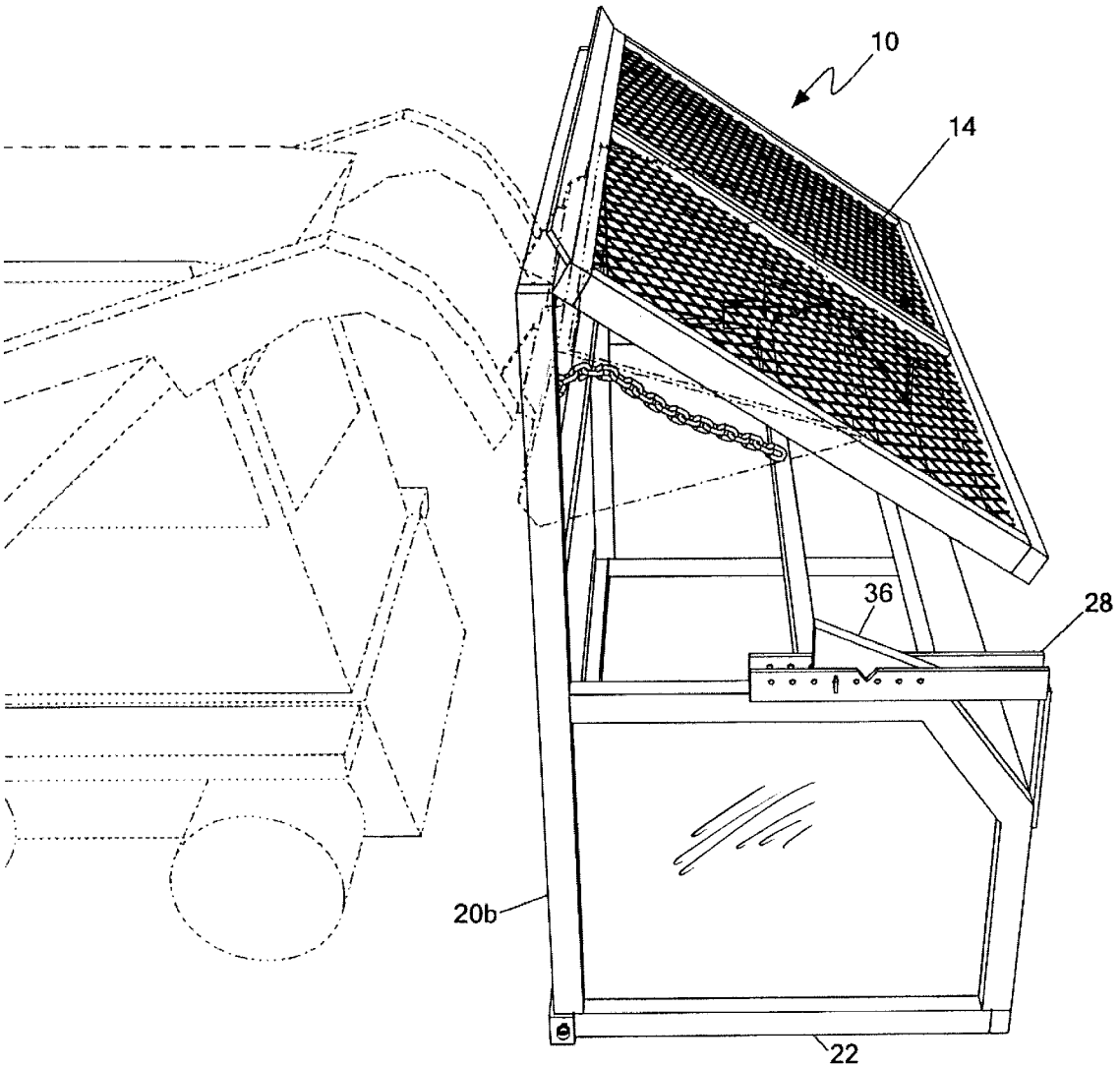
FIG. 4 is, in side perspective view, the operation of the front end loader bucket rotating the soil screener screen upwardly.

An operator may adjust the inclination of screen 10 by inserting the bucket through an upper rear opening in the supporting frame and underneath the screen as seen in FIG. 4. Raising or rotating the bucket pivots the screen about hinges 18. This relieves the downward pressure of the screen frame bearing against wedges 36 so that the position of wedges 36 in channel members 28 may be adjusted to reduce or increase the inclination of screen 10 once lowered to again rest the screen frame against the wedges. Adjusting the inclination of screen 10 allows an operator to vary the amount of soil which may typically be screened from unscreened soil and rubble or gravel aggregate.

With the bucket underneath screen 10 so as to elevate the screen such as seen in FIG. 4, an operator may also slightly bounce the bucket up and down or slightly rotate the tip of the bucket up and down to assist in further filtering soil through the screen mesh or to assist in releasing any rubble or brush or the like which has not flowed or rolled off from the lower end of the screen.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A soil screening device comprising:

a screen frame having a screening surface, a supporting frame having rearwardly disposed rigid uprights supporting said screen frame, said screen frame pivotally mounted to a first upper member mounted at an upper end of said uprights, for pivoting between a lowered position and an elevated position, said supporting frame having a base frame extending forwardly of said uprights, upper members of said base frame having at least one wedge selectively positionably mounted atop said upper member of said base frame and positionable to engage a lower edge of said screen frame when in said lowered position bearing down on an upper inclined surface of said at least one wedge, wherein said at least one wedge is selectively positionable relative to said upper members of said base frame so as to selectively adjust an angular orientation of said screen frame relative to said uprights, said uprights defining a first rear opening between said uprights and under said screen frame sized to accept a front end loader bucket therethrough for engagement of the bucket with an underside of said screen frame, said base frame defining a second rear opening below said first rear opening and sized to accept the bucket therethrough for engagement of the bucket with cross members of said base frame.

2. The device of claim 1 wherein said cross members include at least a rear-most cross member adjacent said uprights, said device further comprising at least one rigid member depending downwardly from said rear-most cross member for releasably locking behind a rear edge of the bucket when fully inserted into and through said second rear opening.

3. The device of claim 1 wherein said upper members included at least one channel member forming an upwardly opening channel in which said at least one wedge is slidably mounted.

4. The device of claim 3 wherein said at least one channel member are perpendicular to said uprights.

5. The device of claim 4 wherein said at least one channel member am orthogonal to said first rear opening.

6. The device of claim 5 wherein said base frame is substantially a parallelepiped and wherein said first and second rear openings are substantially rectangular.

7. The device of claim 6 wherein said uprights are a parallel and spaced apart pair of uprights bounding opposite ends of said first and second rear opening.

8. The device of claim 7 wherein said first upper member is a horizontal cross bar between said uprights and wherein an upper edge of said screen frame is parallel to said horizontal cross bar and pivotally mounted thereto by hinge means.

9. The device of claim 8 wherein a deflecting bar is mounted along said upper edge of said screen frame so as to at least partially cover said hinge means.

10. The device of claim 1 wherein said base frame is sheeted across the front thereof.

11. The device of claim 10 wherein an upper forward edge of said base frame is bevelled and sheeted so as to extend beneath said lower edge of said screen frame when in said lowered position to deflect debris falling from said screening surface forwardly from said base frame.

12. The device of claim 3 wherein said at least one channel member includes locking means for releasably lockably positioning said at least one wedge along said at least one channel member.

13. The device of claim 12 wherein said at least one channel member is a parallel pair of spaced apart channel members mounted adjacent opposite ends of said base frame, and wherein said at least one wedge is a pair of wedges mounted in said channel members.

14. A soil screening device comprising:

a screen frame having a screening surface, a supporting frame having rearwardly disposed rigid uprights supporting said screen frame, said screen fame pivotally mounted to a first upper member mounted at an upper end of said uprights, for pivoting between a lowered position and an elevated position, said supporting frame having a base frame extending forwardly of said uprights, upper members of said base frame having at least one wedge selectively positionably mounted atop said upper member of said base frame and positionable to engage a lower edge of said screen frame when in said lowered position bearing down on an upper inclined surface of said at least one wedge, wherein said at least one wedge is selectively positionable relative to said upper members of said base frame so as to selectively adjust an angular orientation of said screen frame relative to said uprights, said uprights defining a first rear opening between said uprights and under said screen frame sized to accept a front end loader bucket therethrough for engagement of the bucket with an underside of said screen frame, said base frame defining a second rear opening below said first rear opening and sized to accept the bucket therethrough for engagement of the bucket with cross members of said base frame, wherein said cross members include at least a rear-most cross member adjacent said uprights, said device further comprising at least one rigid member depending downwardly from said rear-most cross member for releasably locking behind a rear edge of the bucket when fully inserted into and through said second rear opening, wherein said upper members include at least one channel member forming an upwardly opening channel in which said at least one wedge is slidably mounted.

15. The device of claim 14 wherein said at least one channel member are perpendicular to said uprights.

16. The device of claim 15 wherein said at least one channel member are orthogonal to said first rear opening.

17. The device of claim 16 wherein said base frame is substantially a parallelepiped and wherein said first and second rear openings are substantially rectangular.

18. The device of claim 17 where said uprights are a parallel and spaced apart pair of uprights bounding opposite ends of said first and second rear openings.

19. The device of claim 18 wherein said first upper member is a horizontal cross bar between said uprights and wherein an upper edge of said screen frame is parallel to said horizontal cross bar and pivotally mounted thereto by hinge means.

20. The device of claim 19 wherein a deflecting bar is mounted along said upper edge of said screen frame so as to at least partially cover said hinge means.

21. The device of claim 14 wherein said at least one channel member includes locking means for releasably lockably positioning said at least one wedge along said at least one channel member.

22. The device of claim 21 wherein said at least one channel member is a parallel pair of spaced apart channel members mounted adjacent opposite ends of said base frame, and wherein said at least one wedge is a pair of wedges mounted in said channel members.

* * * * *